US009228400B2

(12) United States Patent
Buytaert et al.

(10) Patent No.: US 9,228,400 B2
(45) Date of Patent: Jan. 5, 2016

(54) DEVICE AND METHOD FOR AFFECTING THE FLOW OF FLUID IN A WELLBORE

(75) Inventors: Jean P. Buytaert, Mineral Wells, TX (US); Troy McDaniel, Weatherford, TX (US)

(73) Assignee: ANTELOPE OIL TOOL & MFG. CO., Mineral Wells, TX (US)

( * ) Notice: Subject to any disclaimer, the term of this patent is extended or adjusted under 35 U.S.C. 154(b) by 431 days.

(21) Appl. No.: 13/025,438

(22) Filed: Feb. 11, 2011

(65) Prior Publication Data

US 2011/0198090 A1 Aug. 18, 2011

Related U.S. Application Data

(60) Provisional application No. 61/304,703, filed on Feb. 15, 2010.

(51) Int. Cl.
*E21B 21/00* (2006.01)
*F15D 1/02* (2006.01)

(52) U.S. Cl.
CPC .. *E21B 21/00* (2013.01); *F15D 1/02* (2013.01)

(58) Field of Classification Search
CPC ... E21B 17/006; E21B 17/10; E21B 17/1021; E21B 17/1071; E21B 17/1078; E21B 37/00; E21B 37/02; E21B 17/1057; E21B 17/1064; F15D 1/02; F15D 1/04; F28F 13/12
USPC ..... 166/170, 173, 177.3, 177.7, 241.1, 166/241.6, 244.1; 175/57, 320, 323, 324; 137/37, 39
See application file for complete search history.

(56) References Cited

U.S. PATENT DOCUMENTS

| | | | | | |
|---|---|---|---|---|---|
| 2,537,797 | A | | 1/1951 | Simpelaar | |
| 2,881,839 | A | * | 4/1959 | Wright et al. | 166/173 |
| 3,240,274 | A | * | 3/1966 | Solum | 166/241.6 |
| 3,294,122 | A | * | 12/1966 | Sharp | 138/110 |
| 3,777,819 | A | | 12/1973 | Delano | |
| 3,982,590 | A | * | 9/1976 | Harriman | 166/173 |
| 4,495,997 | A | * | 1/1985 | Scott et al. | 166/285 |
| 4,501,322 | A | * | 2/1985 | Martin | 166/173 |
| 4,595,058 | A | * | 6/1986 | Nations | 166/285 |
| 4,658,896 | A | | 4/1987 | Milam | |
| 4,818,888 | A | | 4/1989 | Lenoir, III | |
| 4,984,633 | A | | 1/1991 | Langer | |
| RE33,660 | E | | 8/1991 | Jelsma | |
| 5,158,140 | A | * | 10/1992 | Ferry | 166/312 |
| 5,363,927 | A | * | 11/1994 | Frank | 175/67 |
| 5,522,467 | A | * | 6/1996 | Stevens et al. | 175/73 |
| 5,778,976 | A | * | 7/1998 | Murray | 166/241.6 |
| 6,009,961 | A | * | 1/2000 | Pietrobelli et al. | 175/269 |
| 6,575,239 | B2 | * | 6/2003 | Allen | 166/170 |

(Continued)

OTHER PUBLICATIONS

International Search Report and Written Opinion, PCT/US11/024510, Apr. 4, 2011, 9 pages.

*Primary Examiner* — Shane Bomar
*Assistant Examiner* — Elizabeth Gitlin
(74) *Attorney, Agent, or Firm* — MH2 Technology Law Group, LLP

(57) ABSTRACT

An apparatus to alter the flow of a fluid (e.g., drilling fluid, mud, cement, etc.) in a wellbore by creating turbulence in the flowing fluid. The apparatus includes a plurality of blade members extending outward from an elongated member. The elongated member is attached to the exterior surface of a tubular that is then positioned in a wellbore.

29 Claims, 7 Drawing Sheets

(56) References Cited

U.S. PATENT DOCUMENTS

| | | | | |
|---|---|---|---|---|
| 7,159,668 | B2 | 1/2007 | Herrera | |
| 8,356,662 | B2 * | 1/2013 | Winn | 166/173 |
| 8,376,043 | B2 * | 2/2013 | Knobloch et al. | 166/173 |
| 2002/0005284 | A1 * | 1/2002 | Allen | 166/173 |
| 2004/0134658 | A1 * | 7/2004 | Bell et al. | 166/297 |
| 2007/0215388 | A1 * | 9/2007 | Kirk et al. | 175/327 |
| 2009/0146381 | A1 * | 6/2009 | Herrera | 277/336 |
| 2010/0071909 | A1 * | 3/2010 | Winn | 166/381 |
| 2010/0218912 | A1 * | 9/2010 | Lawless et al. | 165/45 |
| 2012/0073803 | A1 * | 3/2012 | Dalmia | 166/241.1 |

* cited by examiner

DEVICE AND METHOD FOR AFFECTING THE FLOW OF FLUID IN A WELLBORE

RELATED APPLICATIONS

This application claims the benefit of U.S. provisional application No. 61/304,703, filed on Feb. 15, 2010.

BACKGROUND

This section provides background information to facilitate a better understanding of the various aspects of the invention. It should be understood that the statements in this section of this document are to be read in this light, and not as admissions of prior art.

Wellbore operations commonly require circulating a fluid (e.g., drilling fluid, mud, cement, etc.) down a tubular disposed in the wellbore and at least partial back up the wellbore toward the surface. For example, during drilling operations a drilling fluid (e.g., mud) is circulated to suspend and carry the drilling cuttings to the surface. Mud is typically pumped down through the inner flow bore of the drill string, out through a drill bit at the bottom of the borehole, and back up through the annulus formed between the drill string and the wellbore wall. It is also common for the drilling fluid to be utilized to power a drilling motor disposed in the bottomhole assembly ("BHA") of the drill string. In vertical wellbores, the velocity vector of the flowing fluid counters the gravity vector. When the velocity vector opposes the gravity vector, the cuttings are easily suspended and lifted from the wellbore. In high-angle wellbores (e.g., deviated, horizontal) the velocity vector of the flowing fluid deviates from vertical while the gravity vector remains vertical. In these wellbores the cuttings tend to settle out of the circulating fluid, e.g., on the low side of the wellbore, forming cutting beds in the wellbore. These cutting beds often result in stuck pipe.

It is common to cement a tubular (e.g., casing, liner) in at least a portion of the wellbore to complete the well. Aside from completions, cementing operations are performed, for example, but not limited to, for remedial actions (e.g., squeezes), plugging sections of wells, setting bridge plugs and plugging and abandoning wells. Cementing operations are relatively expensive operations within themselves and incomplete and/or unsuccessful cementing operations can result in lost time, lost equipment, and from time to time loss of production or injection capabilities. An unsuccessful cementing operation can result, for example, from an insufficient volume of cement slurry used, too short of setting time and/or a poor distribution of the cement slurry around the tubular. One characteristic of a successful cementing operation may be creating a substantially homogeneous seal (e.g., cement layer) around the tubular.

SUMMARY

According to one or more aspects of the invention, an apparatus comprises a tubular having an exterior surface; an elongated member disposed on the exterior surface, wherein a first end of the elongated member is attached to the tubular at a first position and a second end of the elongated member is attached to the tubular at a second position spaced axially away from the first position; and a plurality of blade members extending radially away from the elongated member and the tubular, wherein the blade members are adapted to induce turbulence in a fluid flowing across the exterior surface of the tubular.

A method, according to one or more aspects of the invention, comprises providing an elongated member having a first end, a second end and a plurality of blade members extending radially away from the elongated member; positioning the elongated member on a tubular, wherein the first end and the second end are spaced axially apart on the tubular and the plurality of blade members extend radially away from the elongated member and the tubular; and disposing the tubular in a wellbore.

A method for affecting the flow of a fluid in a wellbore according to one or more aspects of the invention comprises providing an apparatus comprising an elongated member having a plurality of blade members extending radially from the elongated member; disposing a bottom surface of the elongated member on a tubular; attaching a first end of the elongated member at a first fixed position on the tubular; moving a second end of the elongated member angularly relative to the longitudinal axis of the tubular to a second fixed position spaced axially from the first fixed position; attaching the second end of the elongated member to the tubular at the second fixed position; and deploying the tubular and connected apparatus in a wellbore.

The foregoing has outlined some of the features and technical advantages of the invention in order that the detailed description of the invention that follows may be better understood. Additional features and advantages of the invention will be described hereinafter which form the subject of the claims of the invention.

BRIEF DESCRIPTION OF THE DRAWINGS

The invention is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
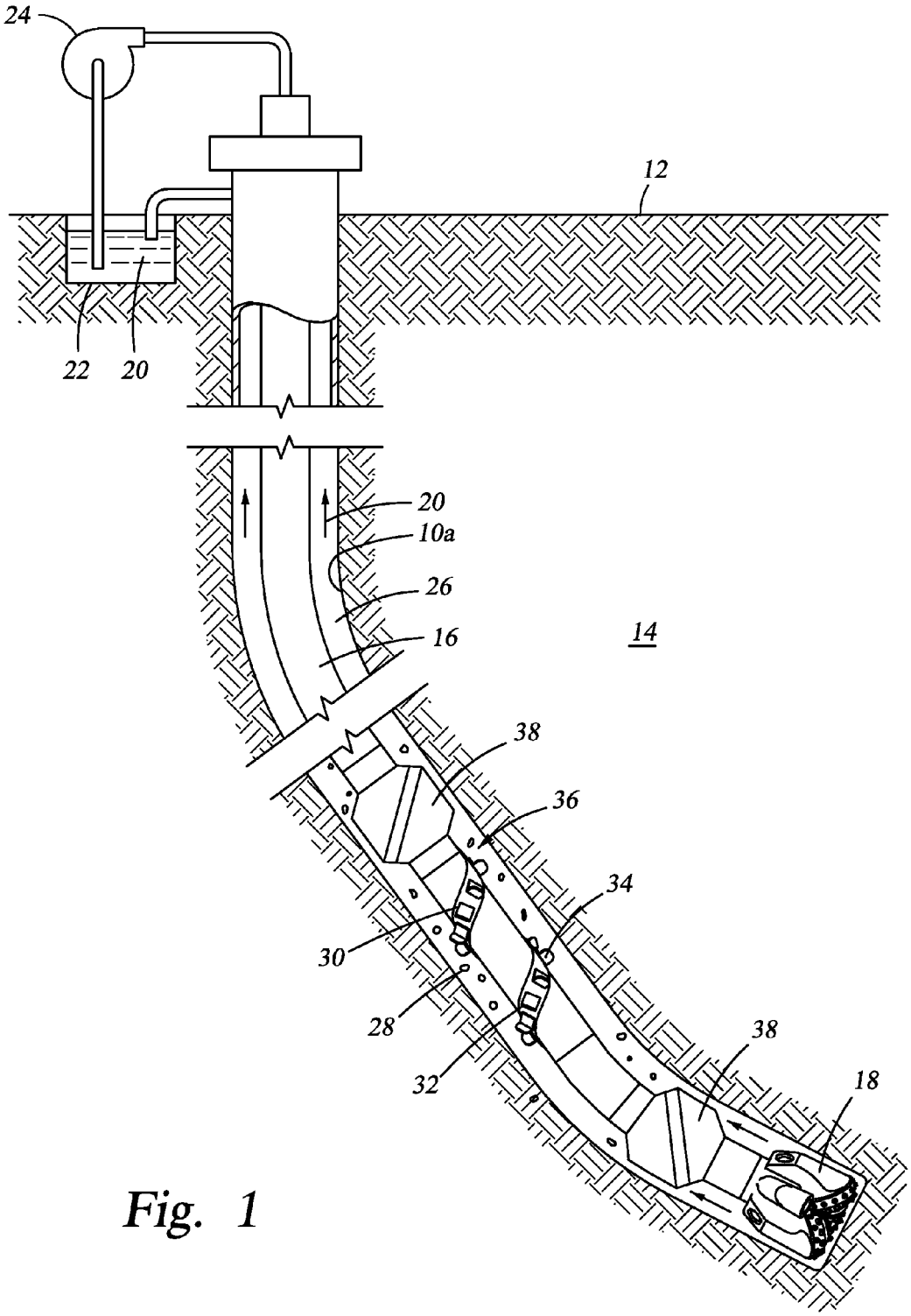
FIG. 1 is a schematic view of an apparatus according to one or more aspects of the invention disposed in a wellbore.

It is to be understood that the following disclosure provides many different embodiments, or examples, for implementing different features of various embodiments. Specific examples of components and arrangements are described below to simplify the invention. These are, of course, merely examples and are not intended to be limiting. In addition, the invention may repeat reference numerals and/or letters in the various examples. This repetition is for the purpose of simplicity and clarity and does not in itself dictate a relationship between the various embodiments and/or configurations discussed.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth of the well being the lowest point, whether the well (e.g., wellbore, borehole) is vertical, horizontal or slanted relative to the surface. The terms "pipe," "tubular," "tubular member," "tubular string," "casing," "liner," tubing," "drill pipe," "drill string" and other like terms can be used interchangeably. The terms may be used in combination with "joint" to mean a single unitary length; a "stand" to mean one or more, and typically two or three, interconnected joints; or a "string" meaning two or more interconnected joints.

In this disclosure, "fluidically coupled" or "fluidically connected" and similar terms may be used to describe bodies that are connected in such a way that fluid pressure may be transmitted between and/or among the connected items. The term "in fluid communication" is used to describe bodies that are connected in such a way that fluid can flow between and/or among the connected items. It is noted that fluidically coupled may include certain arrangements where fluid may not flow between the items, but the fluid pressure may nonetheless be transmitted. Thus, fluid communication is a subset of fluidically coupled.

FIG. 1 is a schematic of an apparatus according to one or more aspects of the invention. FIG. 1 generally depicts a wellbore 10 being drilled from a surface 12, e.g., from a rig (not shown), into a subterranean formation 14. A tubular 16 (e.g., drillpipe, coil tubing, etc.) having a drill bit 18 connected at the end of the tubular distal from surface 12 is depicted drilling wellbore 10. Fluid 20 (e.g., drilling fluid, mud) is depicted as being circulated from a reservoir 22 (e.g., tank, pit) via a pump 24, down the interior bore of the tubular and is discharged at drill bit 18 and circulated back to surface 12 through the annulus 26 formed between the tubular and the wellbore 10 wall 10*a* in this depiction. Fluid 20 is utilized, at least in part, for carrying drill cuttings 28 (e.g., debris) to surface 12. A common problem encountered while drilling, in particular drilling non-vertical sections, is that cuttings 28 drop out of the fluid 20 stream flowing in annulus 26 and form cutting beds, e.g., in the low side of wellbore 10. The formation of cutting beds, e.g., being an obstruction in the annulus, can result in the tubular becoming stuck in the wellbore and limit the length (e.g., total depth) and/or deviation from vertical that a wellbore can achieve.

According to one or more aspects of the invention, an apparatus 30 is positioned on and/or about a portion (e.g., tubular joint, sub, drill collar, motor, etc.) of the tubular. Apparatus 30 includes an elongated base member 32 (e.g., band, strap, etc.) connected to the tubular. For example, at least the opposing ends of the base member are attached to tubular 16. A plurality of spaced apart blade members 34 extend radially outward (e.g., away) from base member 32 and tubular 16 into annulus 26 and the flow fluid 20.

Depicted in FIG. 1, apparatus 30 is disposed proximate to drill bit 18, for example, along the bottomhole assembly ("BHA") 36. Apparatus 30 may be utilized with a rotating tubular (e.g., rotary drilling) and non-rotating portions such as a system utilizing a mud motor. In the depicted example, apparatus 30 is disposed between opposing stabilizers 38. Substantially rigid standoffs (e.g., stabilizers 38) may be utilized to limit the contact of apparatus 30 with the wall of the wellbore to prevent the blade members from contacting the wall and/or being damaged, e.g., crushed. Base member 32 and blade members 34 may be constructed of the same or different types of material (e.g., metal, composites, elastomers). It may be desired for apparatus 30 or at least for blade members 34 to be constructed of a drillable material.

According to one or more aspects of the invention, apparatus 30 passively induces turbulence in the flow of fluid 20 which may promote maintaining cuttings 28 in the flowing fluid 20 increasing the removal of cuttings 28. Apparatus 30 provides beneficial turbulence in fluid 20 and helps reduce the equivalent circulating density ("ECD") of fluid 20. The effective density exerted by a circulating fluid against the formation that takes into account the pressure drop in the annulus above the point being considered. The ECD is calculated as: d+P/[0.052*D]; wherein "d" is the mud weight (e.g., pounds/gallon), "D" is the true vertical depth (e.g., feet) from the surface to the point considered, and "P" is the pressure drop in the annulus between depth D and the surface (e.g., psi). The ECD is an important parameter in avoiding kicks and losses, particularly in wells that have a narrow window between the fracture gradient and the pore-pressure gradient of the formation.

Figure 2:
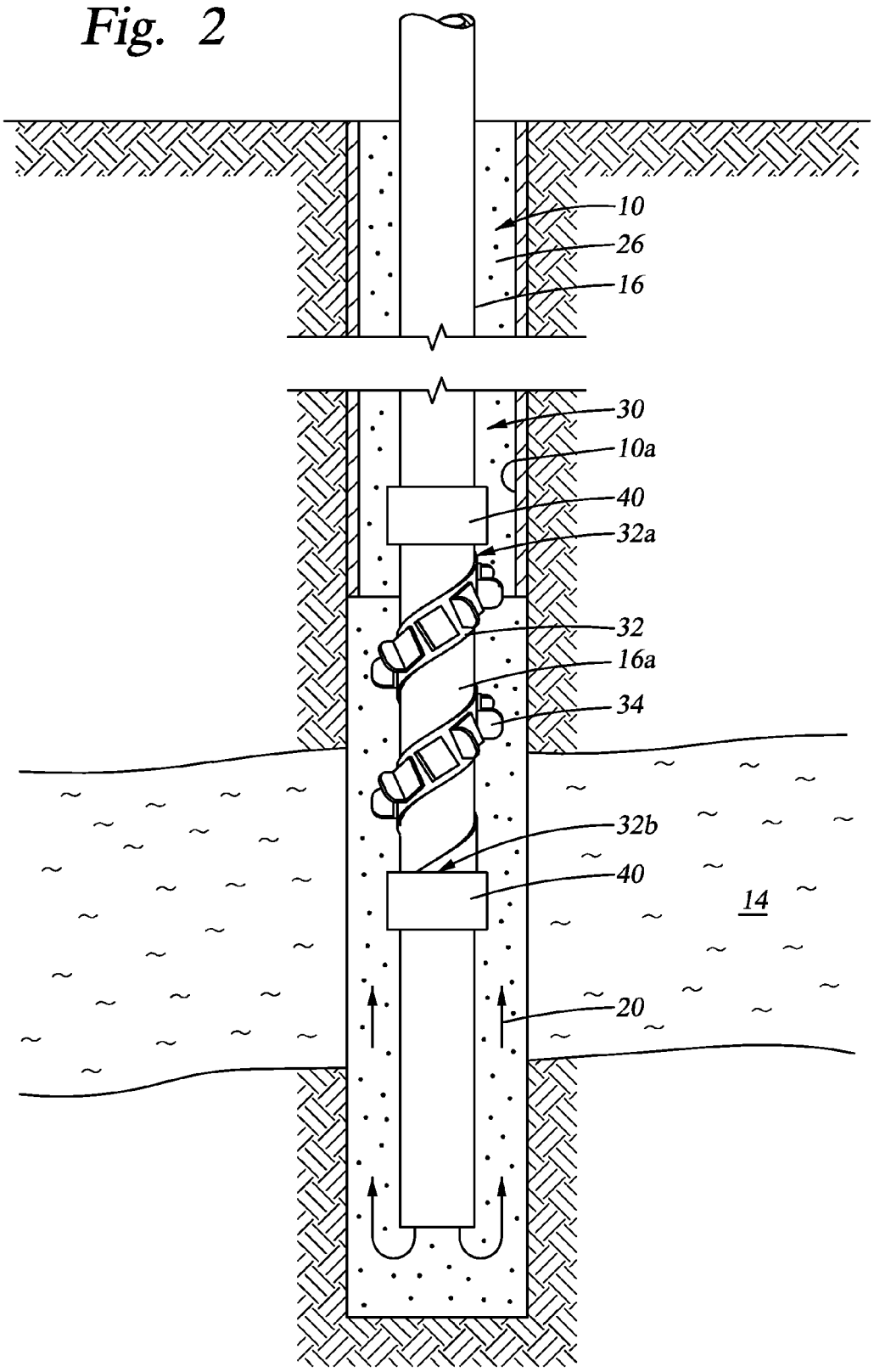
FIG. 2 is a schematic view of another embodiment of an apparatus according to one or more aspects of the invention disposed in a wellbore.

FIG. 2 is a schematic of an apparatus 30 according to one or more aspects of the invention disposed in a wellbore 10. FIG. 2 depicts a cementing operation being performed in wellbore 10. Wellbore 10 is depicted as a vertical wellbore, however, methods of the invention may be performed in vertical and non-vertical wellbores. In this example, a tubular 16, or at least a portion of a tubular, is being cemented in wellbore 10. In this example, fluid 20 is cement (e.g., cement slurry) which is pumped into the well through the interior bore of tubular 16, discharged into wellbore 10 and pumped to a desired level in annulus 26 formed in this example between tubular 16 and the wall 10*a* of wellbore 10.

Apparatus 30 is connected to tubular 16 and comprises an elongated base member 32 disposed along the exterior surface 16*a* of a portion of tubular 16 having a plurality of spaced apart blade members 34 extending radially away from tubular 16 into annulus 26 and the flowing fluid 20. According to one or more aspects of the invention, apparatus 30 is adapted to alter the flow of fluid 20 and to induce turbulence in fluid 20. Depicted in FIG. 2, the opposing ends 32*a*, 32*b*, (e.g., first and second ends) of base member 32 are attached to tubular 16 to secure apparatus 30 at least axially relative to a position on the tubular. In FIG. 2, apparatus 30 is attached to tubular 16 at ends 32*a*, 32*b* by members 40 (e.g., stop collars as are known in the art). According to one or more aspects of the invention, base member 32 may not be attached to tubular 16 between first and second ends 32*a*, 32*b* thereby permitting some movement of blade members 34 in fluid 20.

Apparatus 30 may be attached to tubular 16 between devices such as stabilizers or centralizers or as depicted in FIG. 1. The configuration depicted in FIG. 2 may facilitate scraping of the mud cake from wall 10*a* and promote a better cement bond.

Figure 3:
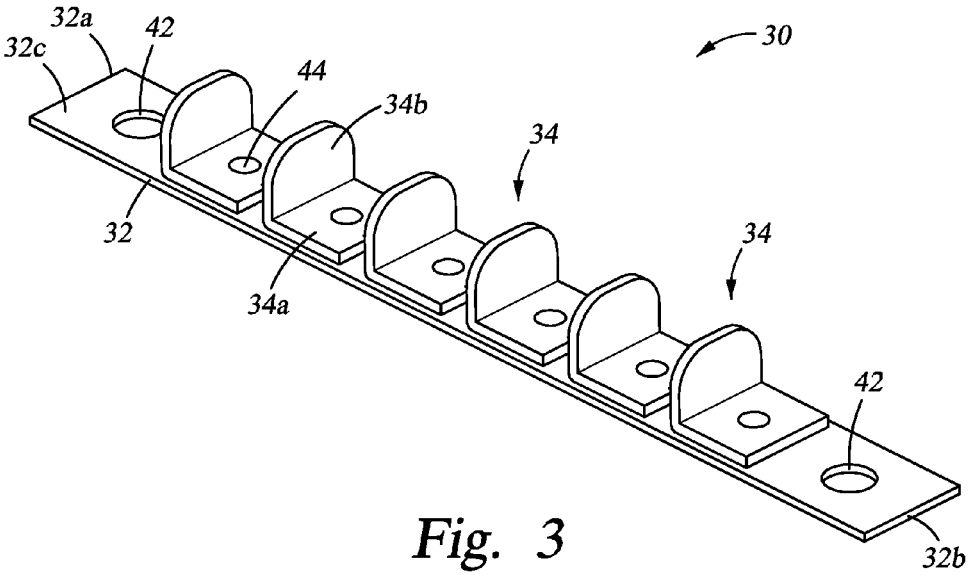
FIG. 3 is a schematic, perspective view of an apparatus according to one or more aspects of the invention depicting blade members attached to an elongated base member.
Figure 6:
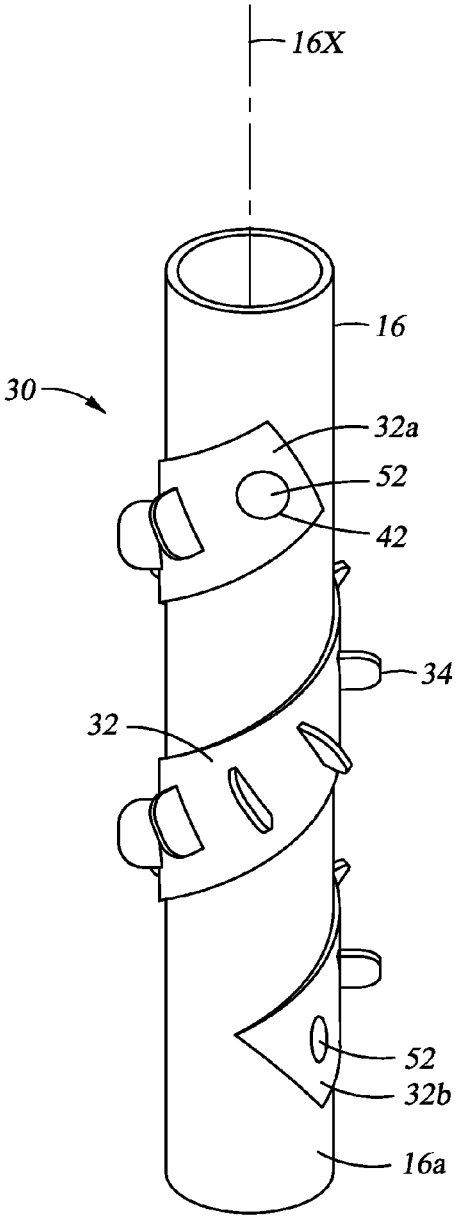
FIG. 6 is a schematic view of an embodiment of an apparatus according to one or more aspects of the invention disposed on a tubular.

FIG. 3 is a schematic, perspective view of an apparatus 30 according to one or more aspects of the invention. Depicted apparatus 30 comprises an elongated planar base member 32 having a top surface 32*c* and a bottom surface 32*d*. In this example, a hole 42 is formed at first end 32*a* and second end, 32*b* for attaching apparatus 30 directly to tubular 16 and/or to a member 40 (e.g., FIG. 2), for example by a bolt, screw, rivet, etc. Depicted blade members 34 are axially spaced apart along base member 32 and extend radially away from top surface 32*c* and away from bottom surface 32*d* which is adapted to be disposed against tubular 16 as illustrated in FIGS. 1 and 2. Blade members 34 (e.g., deflectors) may be formed as a unitary portion (e.g., molding) of base member 32 (see FIG. 6) or as a separate member from base member 32. Blade members 34 may be individual members having a lateral leg 34*a* and a radial leg 34*b*. Apparatus 30 depicted in FIG. 6 is constructed as a unitary piece (e.g., molding, etc.) wherein blade members 34 extend radially away from base member 32. In FIG. 3, lateral leg 34*a* is disposed on top surface 32*c* of base member 32 so that radial leg 34*b* extends away from surface 32*c*. Blade members 34 may be attached to base member 32 in various manners including bolting, welding, adhesives, vulcanization, crimping, riveting, screws, molding and the like. In some embodiments, blade members 34 may be moveably attached to base member 32 for example to rotate (e.g., swivel) relative to base member 32. Movement may be limited to a selected range of movement. Depicted in FIG. 3, blade members 34 are attached to base member 32 via a connector 44 depicted as a rivet. Connector 44 may rigidly, e.g., preventing movement, attach blade members 34 and base member 32 or provide a moveable attachment of blade members 34 to base member 32.

Figure 4:
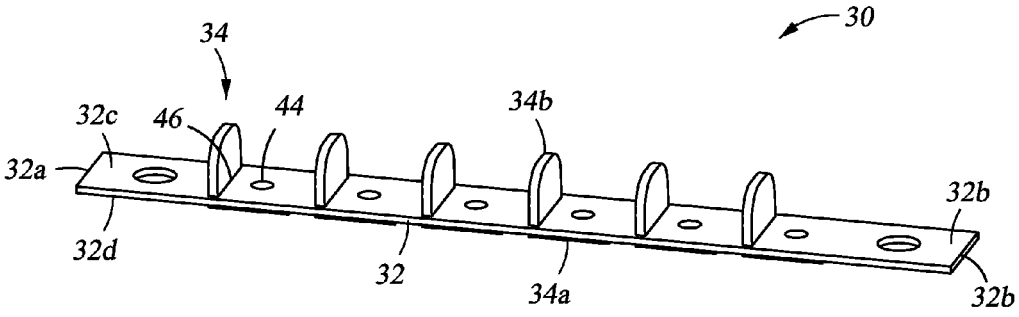
FIG. 4 is a schematic view another embodiment of an apparatus according to one or more aspects of the invention depicting blade members having a lateral leg disposed below an elongated member.
Figure 5A:
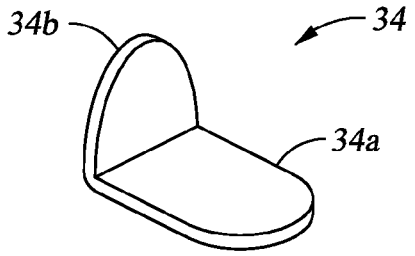
FIGS. 5A-5F are schematic views depicting examples of profiles of blade members according to one or more aspects of the invention.
Figure 5D:
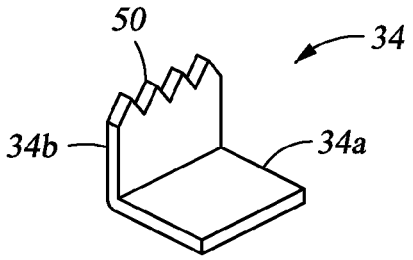
Figure 5B:
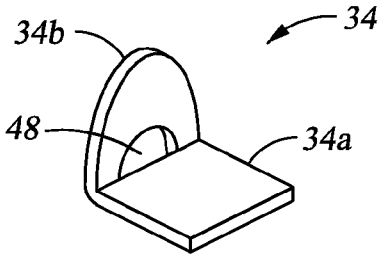
Figure 5E:
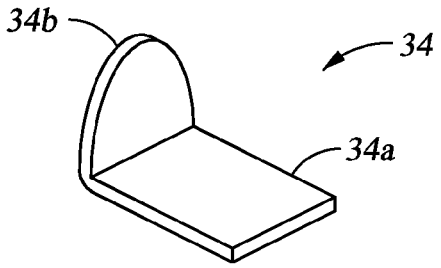
Figure 5C:
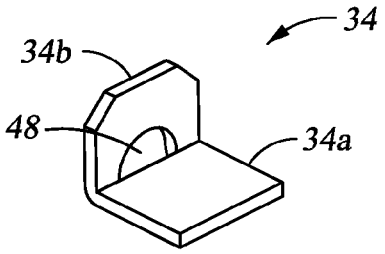
Figure 5F:
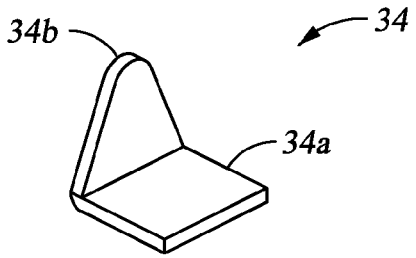

FIG. 4 is a schematic of an embodiment of apparatus 30 according to one or more aspects of the invention. In this example, base member 32 and blade members 34 are separate members. Lateral legs 34*a* are depicted disposed below base member 32 and extending along bottom surface 32*b*. Radial legs 34*b* extend from lateral legs 34*a* through slots 46 in base member 32. Blade members 34 are again depicted attached to base member 32 via connectors 44. One or more of blade members 34 may be rigidly (e.g., fixedly) attached to base member 32 (e.g., stationary relative to base member 32) and/or moveably (e.g., swivelingly, pivotedly, rotatingly) attached.

FIGS. 5A through 5F are schematic illustrations of examples of blade members 34 according to one or more aspects of the invention. As described above, blade members 34 may be formed as a unitary portion of base member 32 (e.g., molding) as depicted in FIG. 6 for example. In FIGS. 5A-5F, blade members 34 are illustrated as individual members for purposes of illustration. According to one or more aspects of the invention, blade members 34 may be constructed to induce turbulence in fluid flow. For example, blade members 34, in particular radial legs 34*b*, may comprise apertures 48 and/or textured or roughened edges 50. The profile of radial leg 34*b* may take various shapes, but not limited to those which are depicted in FIGS. 5A to 5F.

FIG. 6 is a schematic of an apparatus 30 according to one or more aspects of the invention. Apparatus 30 is depicted disposed in a spiral pattern about tubular 16. Base member 32 is disposed on exterior surface 16*a* of tubular 16. First and second ends 32*a*, 32*b* are spaced axially apart relative to tubular 16. In this embodiment, ends 32*a*, 32*b* are physically attached to tubular 16 for example by connector 52 disposed for example with hole 42 (FIG. 3). Connector 52 may include or represent, without limitation, one or more of a bolt, screw, weld, adhesive (e.g., epoxy) or the like. Depicted in FIG. 6, connectors 52 are bolt type members attaching ends 32*a*, 32*b* to tubular 16 in a manner limiting or preventing axial movement along tubular 16 but allowing rotational movement (e.g., non-axial, pivoting, swiveling, rotating) relative to tubular 16 and connector 52. A rotational type connection at end 32*a* and/or end 32*b*, according to one or more aspects of the invention, facilitates movement of apparatus 30 (e.g., blade members 34) in response to fluid flow and/or movement of tubular 16.

FIG. 6 depicts blade members 34 as planar members extending outwardly from base member 32 and tubular 16. Blade members 34 may be attached to base member 32 (e.g., welded) or may be of a unitary construction (e.g., same piece of material) as base member 32 (e.g., molded). Blade members 34 (e.g., radial legs) may be oriented in various manners relative to base 32 and/or tubular 16. For example, some or all of the blade members 34 may be oriented substantially parallel to one another or at non-perpendicular angles between adjacent blade members. Blade members 34 may be oriented parallel to the longitudinal axis of tubular 16 or at a non-perpendicular angle from the longitudinal axis of tubular 16 as depicted in FIG. 6. Blade members 34 may be oriented parallel to the longitudinal axis of base member 32 or at a non-perpendicular angle from the longitudinal axis of base member 32.

Figure 7:
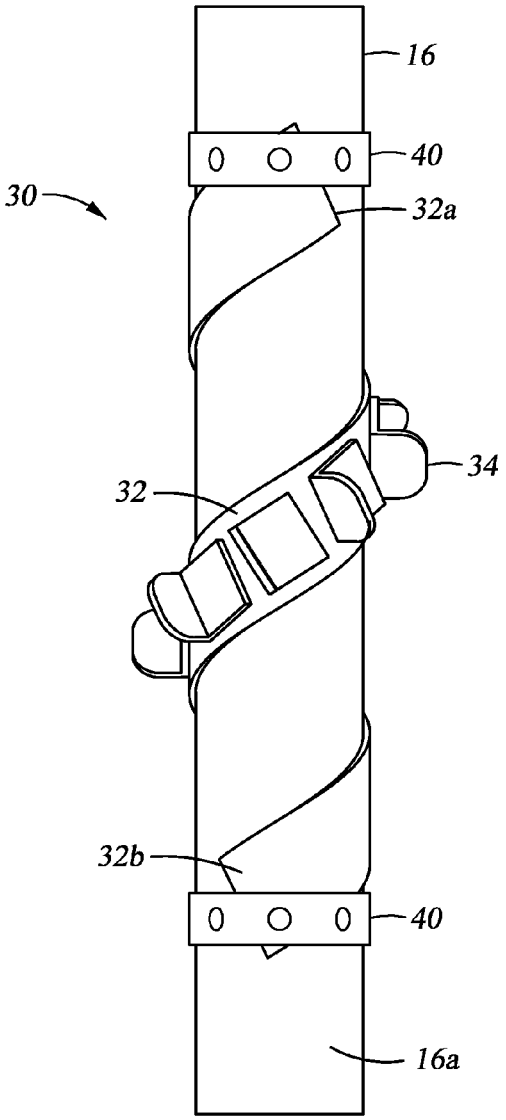
FIG. 7 is a schematic view of another embodiment of an apparatus according to one or more aspects of the invention disposed on a tubular.

FIG. 7 is a schematic view of an apparatus 30 according to one or more aspects of the invention. In this example, ends 32*a*, 32*b* of apparatus 30 are attached (e.g., secured) to tubular 16 by members 40 (e.g., stop collars). As described above, end 32*a* and/or end 32*b* may be attached to tubular 16 in a manner permitting non-axial movement (e.g., pivoting, swiveling, rotating) or rigidly attached to restrict or eliminate axial and non-axial movement.

Apparatus 30 may be disposed on tubular 16 in various patterns depicted in the Figures and not depicted. As will be understood by one skilled in the art with access to this disclosure, apparatus 30 may be disposed in a spiral (e.g., helical) pattern around a portion of tubular 16, partially circling tubular 16 and with base member 32 aligned parallel with the longitudinal axis of tubular 16.

Figure 8A:
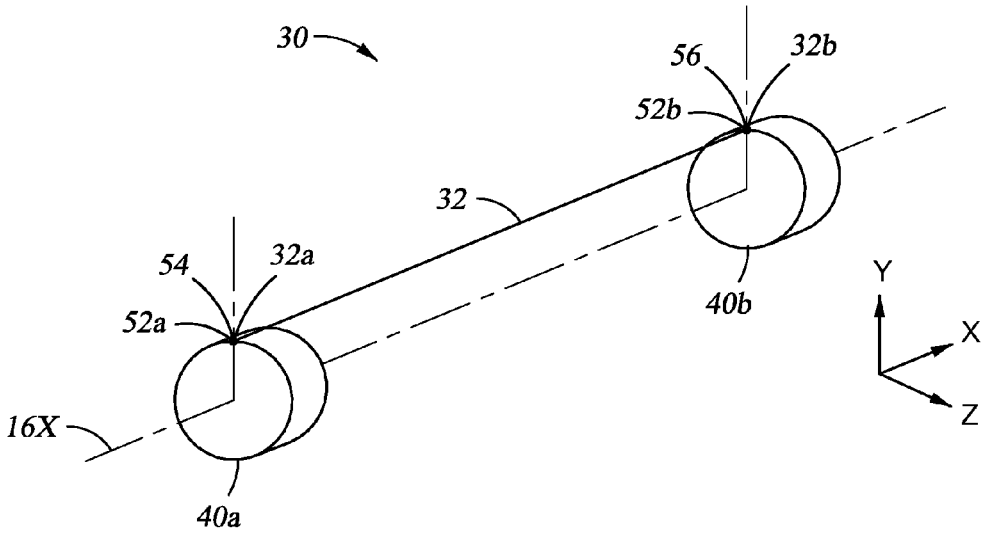
FIGS. 8A and 8B are schematic depictions of one or more aspects the apparatus of the invention.
Figure 8B:
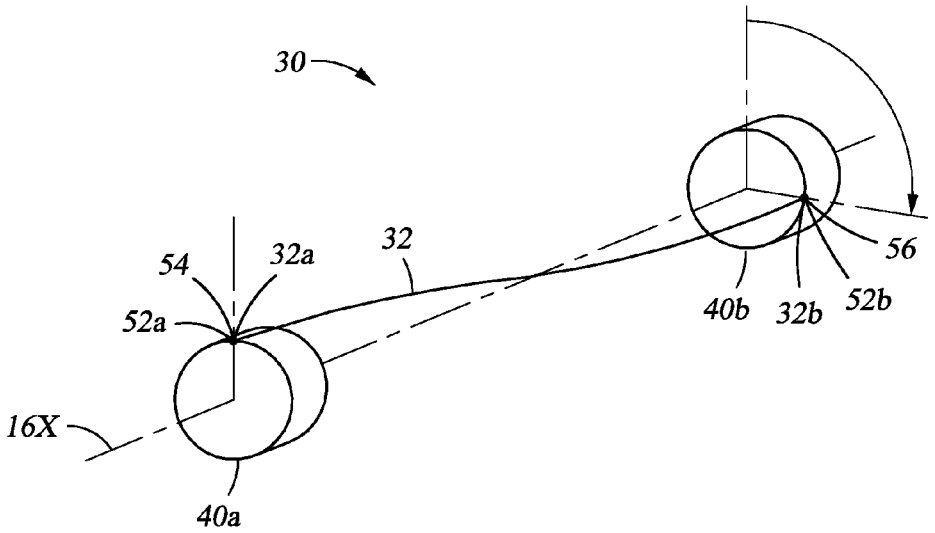

FIGS. 8A and 8B are conceptual schematics illustrating the positioning of an apparatus with a tubular according to one or more aspects of the invention. The tubular is conceptually represented by longitudinal axis 16X. Base member 32 is depicted disposed on the tubular and extending between members 40*a* and 40*b* (e.g., stop collars) for purposes of attaching the opposing ends of base member 32 to the tubular. In FIG. 8A, base member 32 is depicted disposed on the tubular extending substantially parallel to longitudinal axis 16X and the vertical (y-axis) plane of longitudinal axis 16X. As such, first end 32*a* is attached at a first fixed position 54 (e.g., relative to the tubular) by a connector 52*a* and second end 32*b* is attached at a second fixed position 56 denoted by connector 52*b*. In this embodiment, first end 32*a* and second end 32*b* are angularly aligned at 0 degrees (e.g., relative to one another and the tubular) for purposes of description.

In FIG. 8B, first end 32*a* may be moveably attached (e.g., non-axially moveable) to the tubular at a first fixed position 54 (e.g., via connector 52 and member 40*a*). Second end 32*b* of base member 32 may then be angularly rotated relative to the tubular (e.g., longitudinal axis 16X) and the first fixed position 54 to the desired second fixed position 56. In the depicted embodiment, the angular movement of second end 32*b* to second fixed position 56 relative to first fixed position 54 disposes base member 32 (and the blade members) in a spiral configuration relative to the tubular. Second end 32*b* may be rigidly or non-axially moveably attached at the second position depicted by connector 52*b* and member 40*b*. A non-axially moveable attachment between member 40*b* and end 32*b* at connector 52*b* facilitates non-axial movement and an axially fixed attachment of end 32*b* to the tubular. Member 40*b* may be attached to the tubular in a manner to secure end 32*b* at second fixed position 56.

Figure 9:
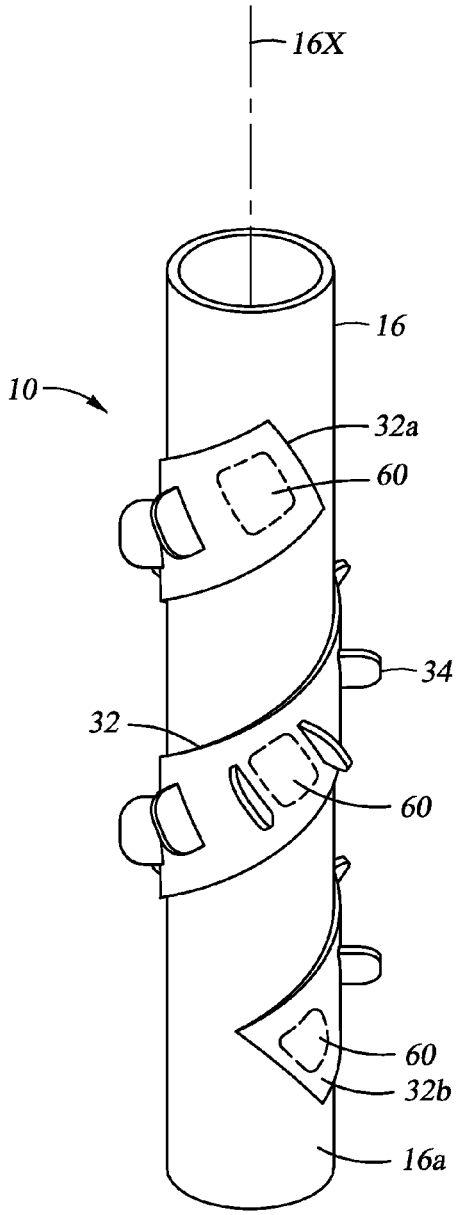
FIG. 9 is a schematic view of another embodiment of an apparatus according to one or more aspects of the invention.

FIG. 9 is a schematic view of another embodiment of an apparatus 30 according to one or more aspects of the invention. In this embodiment, apparatus 30 is attached to tubular 16 via an adhesive 60 (e.g., epoxy) indicated by the dashed lines. Apparatus 30 can be attached at its opposing ends 32*a*, 32*b* to tubular 16 without securing base member 32 to tubular 60 along the portion between ends 32*a*, 32*b* in a manner such that blade members 34 are moveable relative to tubular 16. In some embodiments, apparatus 30 may be attached (e.g., secured) substantially along its length to tubular 16 as depicted in FIG. 9. Apparatus 30 depicted in FIG. 9 comprises a unitary apparatus wherein blade members 34 are formed as a unitary portion of base member 32.

Figure 10:
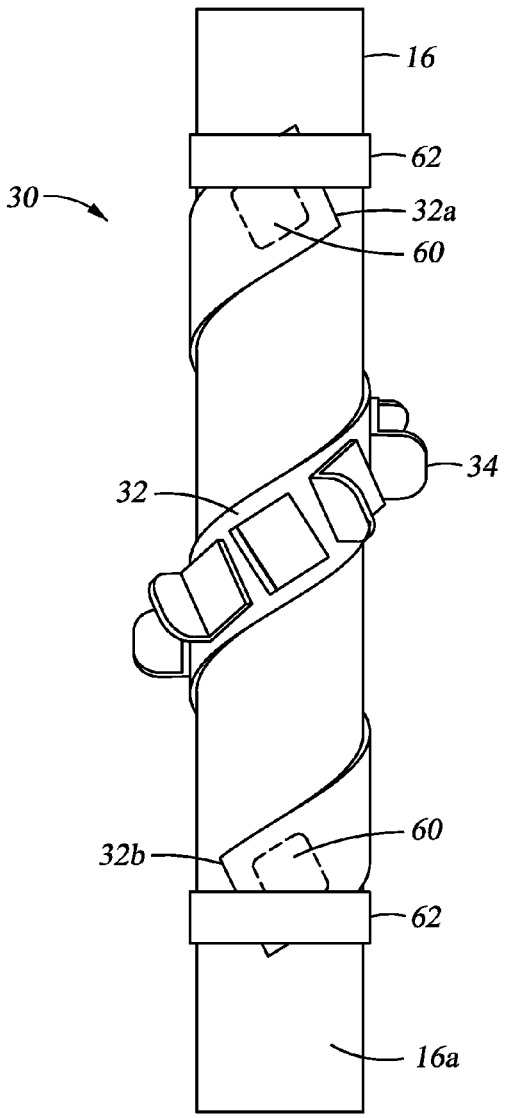
FIG. 10 is a schematic view of another embodiment of an apparatus according to one or more aspects of the invention.

FIG. 10 is a schematic view of another embodiment of an apparatus 30 according to one or more aspects of the invention. Apparatus 30 depicted in FIG. 10 is attached to tubular 16 at its opposing ends 32*a*, 32*b* by an adhesive 60 indicated by the dashed lines. FIG. 10 illustrates apparatus 30 (e.g., base member 32) held in a fixed position relative to tubular 16, via device 62, at least for a time period in which adhesive 60 is setting up. Device 62 may comprise any devise adapted to hold apparatus 30 with tubular 16 for the desired period of time. For example, device 62 may be a clamp or an adhesive tape. The holding device 62 may be removed prior to running apparatus 30 into the wellbore. In some embodiments it may be desired to leave holding device in place when apparatus 30 is run into the wellbore. For example, with reference to FIG. 1, apparatus 30 may be positioned between rigid offset wellbore offset devices such as stabilizers 38, thus providing protection to holding device 62 and/or apparatus 30 as it is being run into the wellbore.

The foregoing outlines features of several embodiments so that those skilled in the art may better understand the aspects of the invention. Those skilled in the art should appreciate that they may readily use the invention as a basis for designing or modifying other processes and structures for carrying out the same purposes and/or achieving the same advantages of the embodiments introduced herein. Those skilled in the art should also realize that such equivalent constructions do not depart from the spirit and scope of the invention, and that they may make various changes, substitutions and alterations herein without departing from the spirit and scope of the invention. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An apparatus comprising:

a tubular having an exterior surface;

an elongated member disposed on the exterior surface, wherein a first end of the elongated member is attached to the tubular at a first position and a second end of the elongated member is attached to the tubular at a second position spaced axially away from the first position, and wherein the first end is angularly offset from the second end, such that the elongated member forms at least part of a helix around at least a portion of the tubular; and a plurality of blade members extending radially away from the elongated member and the tubular, wherein the blade members are adapted to induce turbulence in a fluid flowing across the exterior surface of the tubular, wherein the plurality of blade members are rotatable with respect to the elongated member at least when the elongated member is attached to the tubular, and wherein the plurality of blade members are rotatable such that an area of the plurality of blade members that obstructs the flow of fluid across the exterior surface of the tubular is adjustable.

2. The apparatus of claim 1, wherein at least the first end is rotationally attached to the tubular.

3. The apparatus of claim 1, wherein at least the first end is moveably attached to the tubular.

4. The apparatus of claim 1, wherein at least the first end is rotationally attached to the tubular and the plurality of blade members are rotationally attached to the elongated member.

5. The apparatus of claim 1, wherein at least the first end is moveably attached to the tubular.

6. The apparatus of claim 1, wherein the elongated member is disposed in an axially spiraling configuration along a portion of the tubular.

7. The apparatus of claim 1, wherein the elongated member is disposed between substantially rigid stand-off members.

8. The apparatus of claim 1, wherein at least a first end of the elongated member is attached to the tubular by an adhesive.

9. The apparatus of claim 1, wherein the plurality of blade members are each rotatable about a rotational axis that intersects a longitudinal axis of the tubular.

10. The apparatus of claim 9, wherein the rotational axis is substantially normal to the longitudinal axis.

11. The apparatus of claim 1, wherein the second end is rotatable relative to the first end at least after securing the first end and the second end to the tubular.

12. The apparatus of claim 11, wherein the elongated member is integrally formed.

13. The apparatus of claim 1, wherein at least two of the plurality of blade members are disposed at different axial positions along the tubular.

14. The apparatus of claim 1, wherein the plurality of blade members are configured to rotate relative to the elongated member without flexing.

15. A method comprising:

providing an elongated member having a first end, a second end and a plurality of blade members extending radially away from the elongated member;

positioning the elongated member on a tubular, wherein the first end and the second end are spaced axially apart on the tubular and the plurality of blade members extend radially away from the elongated member and the tubular, and wherein positioning comprises attaching the first end and the second end of the elongated member to the tubular, wherein the second end is rotationally moveable relative to the first end and the tubular after attaching the first end and the second end of the elongated member to the tubular;

disposing the tubular in a wellbore; and flowing a fluid across the plurality of blade members, wherein the plurality of blade members induce a turbulence in the fluid in response to the fluid flowing across the plurality of blade members, and wherein the plurality of blade members are rotatable with respect to the tubular such that an area of the plurality of blade members that obstructs the flow of fluid across the exterior surface of the tubular is adjustable.

16. The method of claim 15, wherein positioning comprises attaching the first end and the second end of the elongated member to the tubular.

17. The method of claim 16, wherein attaching comprises using an adhesive.

18. The method of claim 15, wherein:

the fluid is comprised of one selected from the group of a drilling fluid and a cement slurry.

19. The method of claim 15, further comprising:

removing debris from the wellbore in response to the turbulence induced in the fluid.

20. The method of claim 15, wherein positioning comprises attaching at least the first end of the elongated member to the tubular with an adhesive.

21. The method of claim 15, wherein the elongated member and the plurality of blade members are of a unitary construction.

22. The method of claim 15, wherein the each of the plurality of blade members is an individual member attached to the elongated member.

23. The method of claim 15, wherein the plurality of blade members comprise a lateral leg positioned along a bottom surface of the elongated member that faces the tubular and a radial leg extending through the elongated member.

24. The method of claim 15, further comprising positioning the elongated member between stand-off members attached to the tubular.

25. The method of claim 15, further comprising:

removing debris from the wellbore in response to the turbulence induced in the fluid.

26. The method of claim 15, further comprising:

rotating the tubular while flowing the fluid across the plurality of blade members.

27. The method of claim 15, wherein the elongated member forms at least part of a helix around at least a portion of the tubular.

28. The method of claim 15, wherein the plurality of blade members each comprise a substantially planar surface extending radially outward from the elongated member, and wherein each of the plurality of blade members are rotatably coupled with the elongated member.

29. An apparatus comprising:

an elongated member disposed on an exterior surface of a tubular, wherein a first end of the elongated member is attached to the tubular at a first position, and a second end of the elongated member is attached to the tubular at a second position spaced axially away from the first position, the first end being angularly offset from the second end such that the elongated member forms at least part of a helix around at least a portion of the tubular; and a plurality of blade members coupled with the elongated member, wherein the plurality of blade members each comprise a substantially planar surface extending radially outward from the elongated member and the tubular, wherein the plurality of blade members are rotatable with respect to the elongated member at least when the elongated member is attached to the tubular, and wherein the plurality of blade members are configured to induce turbulence in a fluid flowing across the exterior surface of the tubular, and wherein the plurality of blade members are rotatable such that an area of the plurality of blade members that obstructs the flow of fluid across the exterior surface of the tubular is adjustable.

* * * * *